US008432313B2

(12) United States Patent
Ma

(10) Patent No.: US 8,432,313 B2
(45) Date of Patent: Apr. 30, 2013

(54) CONFORMAL AND COMPACT WIDEBAND ANTENNA

(75) Inventor: Guozhong Ma, Farnborough (GB)

(73) Assignee: Nokia Corporation, Espoo (FI)

( * ) Notice: Subject to any disclaimer, the term of this patent is extended or adjusted under 35 U.S.C. 154(b) by 845 days.

(21) Appl. No.: 12/308,722

(22) PCT Filed: Jun. 23, 2006

(86) PCT No.: PCT/IB2006/001736
§ 371 (c)(1),
(2), (4) Date: Dec. 22, 2008

(87) PCT Pub. No.: WO2008/001148
PCT Pub. Date: Jan. 3, 2008

(65) Prior Publication Data
US 2009/0284420 A1 Nov. 19, 2009

(51) Int. Cl.
*H01Q 1/24* (2006.01)
*H01Q 1/38* (2006.01)
*H01Q 21/30* (2006.01)

(52) U.S. Cl.
USPC ..... 343/700 MS; 343/725; 343/846

(58) Field of Classification Search ..... 343/700 MS, 343/725, 729, 846, 848
See application file for complete search history.

(56) References Cited

U.S. PATENT DOCUMENTS

| | | | | |
|---|---|---|---|---|
| 6,320,545 | B1 | 11/2001 | Nagumo et al. | 343/700 |
| 6,452,558 | B1 * | 9/2002 | Saitou et al. | 343/725 |
| 7,218,282 | B2 * | 5/2007 | Humpfer et al. | 343/700 MS |
| 7,268,730 | B2 * | 9/2007 | Park et al. | 343/700 MS |
| 2001/0043159 | A1 | 11/2001 | Masuda et al. | 343/700 |
| 2005/0116867 | A1 | 6/2005 | Park et al. | 343/725 |
| 2005/0253761 | A1 | 11/2005 | Tung | 343/702 |
| 2006/0044191 | A1 | 3/2006 | Harihara | 343/700 MS |

FOREIGN PATENT DOCUMENTS

| | | | |
|---|---|---|---|
| EP | 0 590 955 | A2 | 4/1994 |
| EP | 1 102 348 | A1 | 5/2001 |
| EP | 1 231 669 | A1 | 8/2002 |

OTHER PUBLICATIONS

Guo Y X et al: "L-probe proximity-fed short-circuited patch antennas", Electronics Letters, IEE Stevenage, GB, vol. 35, No. 24, Nov. 25, 1999, pp. 2069-2070, XP006013020, ISSN: 0013-5194, DOI: 10.1049/EL: 19991446 (2 pages).

* cited by examiner

*Primary Examiner* — Michael C Wimer
(74) *Attorney, Agent, or Firm* — Harrington & Smith

(57) ABSTRACT

A substrate such as a printed wiring board defines a cutout of grounding metallization. A monopole radiating element is spaced laterally from edges of the grounding metallization in the cutout. A patch radiating element is spaced laterally from edges of the grounding metallization in the cutout. The monopole and patch radiating elements overlie at least a portion of one another to enable inductive coupling through an aperture characterized by the absence of grounding metallization, and the patch radiating element is shorted at a corner to the grounding metallization.

23 Claims, 11 Drawing Sheets

3.4GHz RESONANCE FROM CONVENTIONAL MONOPOLE PATCH WITH SIZE 11*10mm

LOW RESONANCES SHIFT AS THE CHANGES IN THE PATCH SIZE

HIGH RESONANCES SHIFT AS THE CHANGES IN MONOPOLE LENGTH

MEASURED AND SIMULATED RETURN LOSS

MEASURED AND SIMULATED AVERAGE GAIN

CONFORMAL AND COMPACT WIDEBAND ANTENNA

TECHNICAL FIELD

The exemplary and non-limiting embodiments of this invention relate generally to wideband or dual band antennas, and are particularly related to mutually coupled monopole and patch antennas.

BACKGROUND

Ultra Wideband (UWB) communication systems have been the focus of increased research in recent years, since such a system can transmit and receive data at an extremely high rate (e.g., from 110 Mb/s to 480 Mb/s in the 10 meter range). It has been predicted that mobile handsets will add UWB functionality around 2007. Many academic papers and patents have been published to target the antenna solution, because the system has a very wide bandwidth (3.1-10.5 GHZ). Most solutions seen to date seek to address the bandwidth concerns without regard to antenna size restrictions. These solutions may therefore be suitable for some devices, for example, PCs and laptop computers, but not for mobile phone handsets and other handheld portable communication devices such as mobile phone handsets, email devices, pocket-sized digital video devices, and the like. Minimum bandwidth and radiation efficiency requirements are a significant challenge for designing UWB antennas for smaller portable communication devices such as those above. Normally, antenna bandwidth and radiation efficiency are proportional to the size of the antenna, so smaller antennas typically exhibit narrow bandwidth and low radiation efficiency.

One conventional antenna that seeks to enable broadband reception in a compact size is described in US Pat. Publication No. 2005/0116867 to Ikmo Park et al (publication date Jun. 2, 2005). That disclosure shows a spiral strip line monopole antenna disposed between a shorted patch antenna and a ground plane. One dielectric substrate lies between the monopole and patch antennas, and another dielectric substrate lies between the ground plane and the monopole antenna. The monopole antenna is quarter wavelength, and the patch is either 11 mm by 11 mm rectangular, or 11 mm diameter round. Small as this may be, it is still seen as to large laterally for some of the more challenging mobile phone handset dimensions currently in use and under development. The tabular design data in that disclosure further shows a height requirement in the 7-10 mm range, resulting in a three dimensional antenna that would be difficult to design into most mobile phone handsets of conventional size. Also, such a tall three-dimensional antenna would reasonably be expected to impose high manufacturing costs.

What is needed is a wideband antenna of very small size, preferably smaller than about 11 mm by 11 mm square, and of low profile to enable use in a variety of mobile communication devices for which physical space is a premium. Advantageously, such an antenna would be simple to manufacture using existing processes so as to hold down incremental costs associated with its manufacture and placement within a completed wireless device.

SUMMARY

The foregoing and other problems are overcome, and other advantages are realized, in accordance with the presently described embodiments of these teachings.

In accordance with an exemplary embodiment of the invention, there is provided an apparatus that includes grounding metallization, a monopole radiating element spaced laterally from edges of the grounding metallization, and a patch radiating element spaced laterally from edges of the grounding metallization. The monopole and patch radiating elements overlie at least a portion of one another, and the patch radiating element is shorted to the grounding metallization.

In accordance with another exemplary embodiment of the invention, there is provided a method (e.g., for making an antenna). In the method, a substrate is provided that defines at least two adjacent edges that form a cutout. The cutout is characterized by the absence of metallization. Within the cutout is disposed a patch antenna and a monopole antenna such that the patch antenna and monopole antenna are spaced from one another and overlie one another at least in part. The patch antenna is disposed so as to be laterally spaced from each of the at least two adjacent edges. The patch antenna is shorted to grounding metallization of the substrate.

In accordance with another exemplary embodiment of the invention, there is provided an apparatus (such as, for example, a portable communication device) that includes first antenna means, second antenna means, and grounding means. The first antenna means is for radiation in a first frequency band. The second antenna means is inductively coupled to the first antenna means for radiation in a second frequency band. The grounding means is spaced from lateral edges of the first and second antenna means and shorted to the second antenna means. At least a portion of the first antenna means overlies at least a portion of the second antenna means. In an embodiment, the first antenna means may be a monopole radiating element, the second antenna means may be a patch radiating element, the grounding means may be metallization plated to a substrate, and the monopole and patch radiating elements are disposed on opposed sides of the substrate.

In accordance with another exemplary embodiment of the invention, there is provided an antenna that includes grounding metallization, a monopole radiating element longitudinally coupled to the grounding metallization, and a patch radiating element longitudinally coupled to the grounding metallization and overlying at least a portion of the monopole radiating element, said patch radiating element shorted to the grounding metallization.

Further details as to various embodiments and implementations are detailed below.

BRIEF DESCRIPTION OF THE DRAWINGS

The foregoing and other aspects of these teachings are made more evident in the following Detailed Description, when read in conjunction with the attached Drawing Figures, wherein.

DETAILED DESCRIPTION OF EMBODIMENTS OF THE INVENTION

Exemplary embodiments of this invention enable a smaller ultra-wideband (UWB) antenna, effective for wavelengths spanning 3-7 GHz and can achieve over −3 dBi gain in the whole band. As an overview, two radiating elements lie on different surfaces of a substrate so as to overlie one another, at least in part. In that respect they may be conformal to the substrate itself and fabricated directly thereon, rather than manufactured separately and assembled with the printed wiring board PWB substrate. In the area where the two radiating elements are fabricated, and overlie one another, at least a portion of that overlying area is characterized by the absence of grounding metallization. This is detailed below as an aperture or slot, through which the two radiating elements are electromagnetically (inductively) coupled. One radiating element has a feeding point, and the other radiating element is shorted to the grounding metallization. The configuration above enables a wideband antenna having a patch antenna of a size nearly half that of other known solutions.

Figure 2:
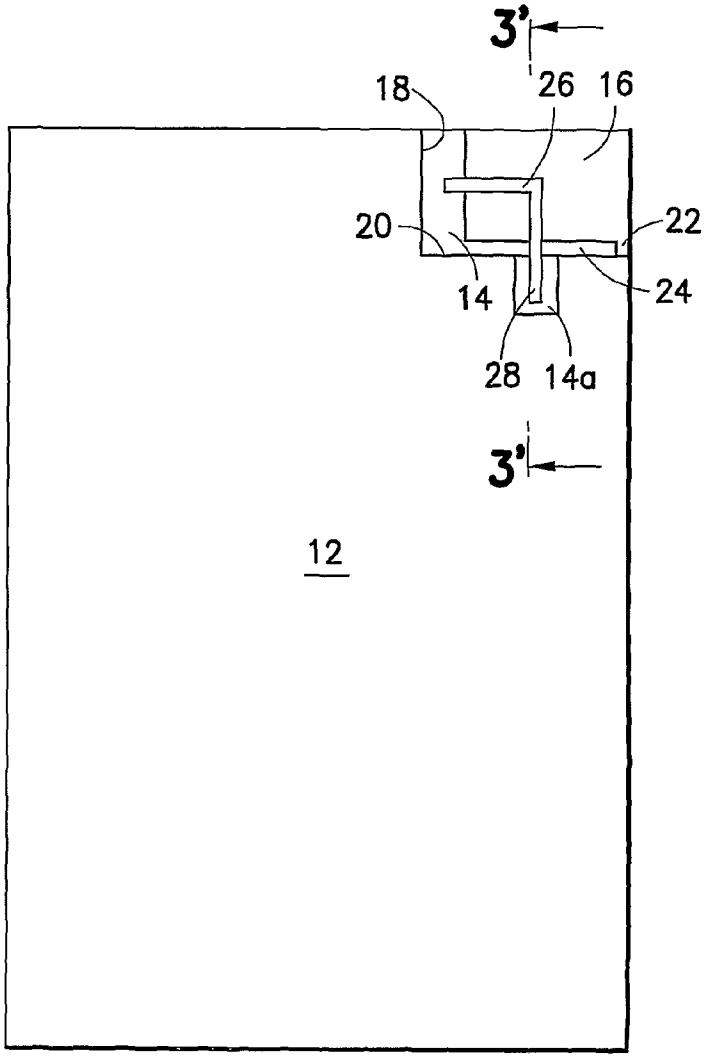
FIG. 2 shows a bottom view of the substrate of FIG. 1, where a monopole radiating element is disposed in spaced relation to grounding metallization of a substrate according to an embodiment of the invention.
Figure 1:
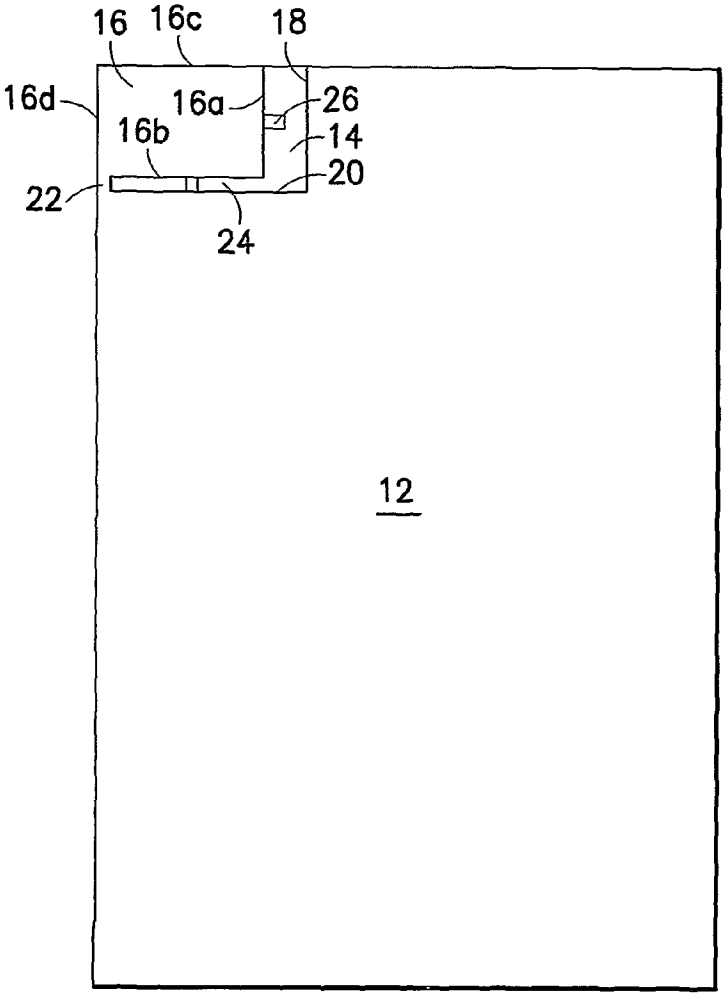
FIG. 1 shows a top view of a substrate, where a patch radiating element is disposed in spaced relation to grounding metallization of a substrate according to an embodiment of the invention.
Figure 3:
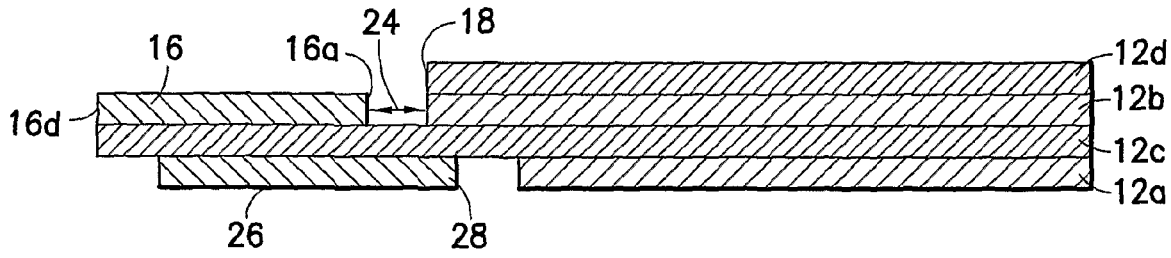
FIG. 3 shows a sectional view along the section lines 3'-3' of FIG. 2.

FIGS. 1-3 show an exemplary embodiment of the inventive antenna 10. Preferably, the substrate is a multi-layer PWB having at least two layers of metallization. In FIGS. 1 and 2, the PWB 12 forms a rectangle and the metallization that serves as the ground plane to the antenna radiating elements mirrors that rectangle but further exhibits cutouts as will be described. A single layer of metallization is possible, wherein that single layer would extend no further than the boundaries shown for the multiple metallization layers shown herein. More typically, PWBs for mobile communication devices employ multiple layers of metallization in a multi-layer PWB, so the exemplary embodiments of this invention are described most conveniently, but not by way of limitation, in the context of a multi-layer PWB.

As seen in FIG. 1, the PWB 12 exhibits a first 'cutout' 14 of at least some layers. A patch antenna 16 is spaced from lateral edges 18, 20 of grounding metallization of the PWB 12. Note that these are plural edges, so that the patch antenna 16 is conformal to a rectangle defined by the PWB 12 and not spaced from a lateral edge thereof, thus saving space. The patch antenna 16 is shorted at a corner to the grounding metallization at a short 22. One edge 16*a* of the patch antenna 16 is spaced about 2 mm from the adjacent edge 18 of the ground plane. Another edge 16*b* is spaced about 0.5 mm from the adjacent edge 20 of the ground plane, so as to define a slot 24 between those edges 16*b* and 20. It is through this slot 24 that inductive coupling between the patch radiating element 16 and the monopole radiating element 26 strongly occurs when the antenna 10 is in operation. While aperture coupling is known in the art, to the inventor's knowledge the prior art approaches all require at least two stacked PWBs rather than the single PWB of embodiments of this invention. The remaining sides 16*c*, 16*d* of the patch radiating element 16 are coincident with lateral edges of the PWB 12 for maximum space efficiency, the conformal characteristic.

Wherein FIG. 1 shows the patch radiating element 16 in the foreground and portions of the monopole radiating element 26 extending from behind it, FIG. 2 shows the reverse surface of the PWB 12. In FIG. 2, the monopole radiating element 26 is in the foreground and the patch radiating element 16 is in the background. In the exemplary embodiment illustrated, the monopole radiation element 26 is bent into an "L" shape to provide both space savings and resonance, but may take the form of other shapes with no appreciable loss of functionality. Monopole radiation element 26 can be fashioned in a straight line or, conversely, can be bent to form a non-linear monopole. A layer of dielectric from the PWB 12 may separate these radiating elements 16, 26 for ease of manufacture, where each are formed on opposed surfaces of the PWB 12 but no grounding metallization lies between them. A cutout 14 similar to that shown in FIG. 1 is also evident, but in FIG. 2 there is an extension 14*a* of the cutout into which a feed point 28 of the monopole radiating element 26 extends. This is to avoid the feed point 28 directly underlying either of the patch radiating element 16 or the slot 24. The feed point 28 is where radio signals are provided to and drawn from the antenna 10, and couples to a transceiver in the overall wireless communication device of which the antenna 10 forms a component. In exemplary embodiments of the invention, the monopole antenna is a "fed" antenna and it can be "fed" or "coupled to" in several standard ways, e.g. "indirectly" using microstrip feeds or lines that are electromagnetically coupled, or "directly" using a galvanic connection to the radio/transceiver as well as via standard components like capacitors, inductors, and resistors.

While both radiating elements 16, 26 are shown as laterally spaced from separate grounding metallizations, it will be appreciated that in alternative exemplary embodiments both radiating elements 16, 26 can reference a single ground plane. For example, the grounding metallization can form a ground plane in a sub-layer of a multi-layer PCB with the radiating elements 16, 26 located one each on opposing sides of the grounding metallization. The physical dimensions of different PWB/PCBs means that it is conceivable that a very thin 8-layer PCB could have tens of microns between each layer. Thus, coupling the patch radiating element 16 to the ground plane could take place by overlapping them partially longitudinally on separate layers as an alternative to "edge coupling" in the same plane or layer.

As will be shown, the architecture of the antenna 10 described with reference to FIGS. 1-2 enables a patch radiation element 16 of dimensions roughly 6×11 mm (including clearance) for a 3-7 GHz bandwidth. The monopole radiating element 26 does not add to the lateral expanse of the patch radiating element 16. In size, this is a distinct advantage over the 11×11 mm patch antenna of the Park publication detailed in the background section above. Such a small size is seen to be appropriate for a multitude of different mobile handset structures, including flip, low profile, slide, and mono-block configurations. The monopole radiating element 26 preferably measures, from the slot 24 to its furthest end and regardless of any bend or meander, one quarter wavelength of the desired center frequency. For the UWB application, its overall length is then about 12 mm (e.g., 11-13 mm), since a small segment extends beyond the slot 24 into the cutout extension 14*a*.

FIG. 3 illustrates a sectional view of the embodiment of FIGS. 1-2. Several layers of the multi-layer PWB are shown, including first and second metallization layers 12*a*, 12*b* and first and second dielectric layers 12*c*, 12*d* (respectively). The patch radiating element 16 is disposed on a first surface of the first dielectric layer 12*c*, which is in the rectangular shape of FIGS. 1-2 and which does not exhibit a cutout in that layer. The monopole radiating element 26 is formed on an opposed second surface of that same layer 12*c*.

Figure 11:
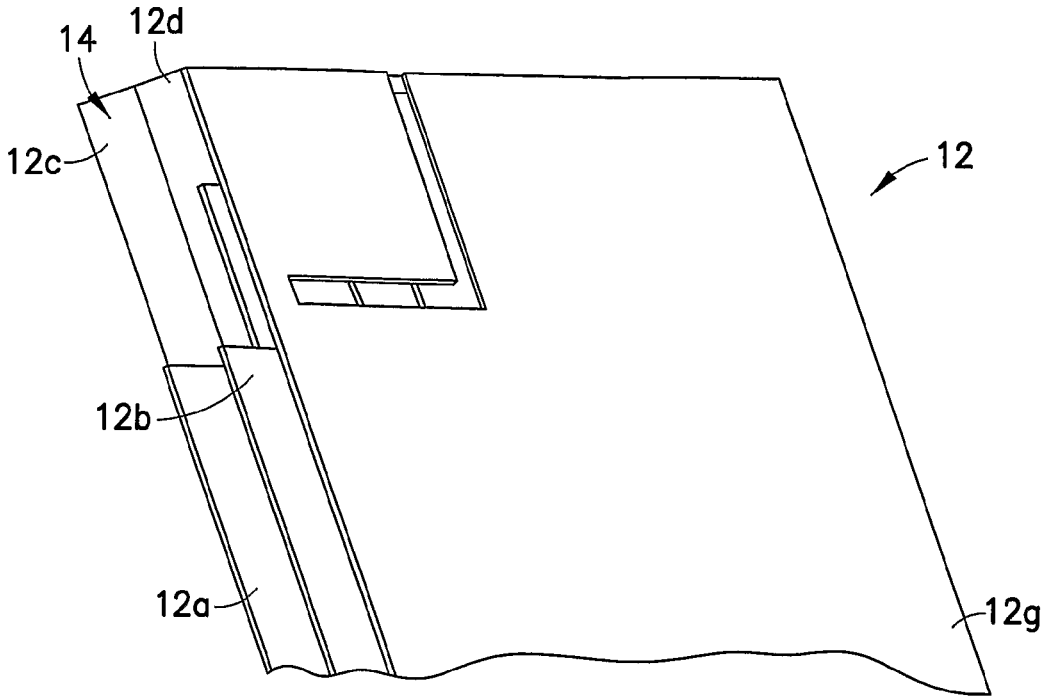
FIG. 11 is a perspective illustration of a PWB according to exemplary embodiments of the invention.

With reference to FIG. 11, there is illustrated another exemplary embodiment of a multi-layer PWB according to the invention. As illustrated, each of the dielectric layers 12*c*, 12*d* is separated by a single metallization layer 12*a*, 12*b*, 12*g*. The metallization layers 12*a*, 12*b*, 12*g* are thin in comparison to the overall thickness of the PWB. In an exemplary embodiment, the patch radiating element 16 is fabricated into the uppermost metallization layer 12*g* while a window of the same size as cutout 14 is incorporated in the lower metallization layers 12*a*, 1*b*.

Figure 12:
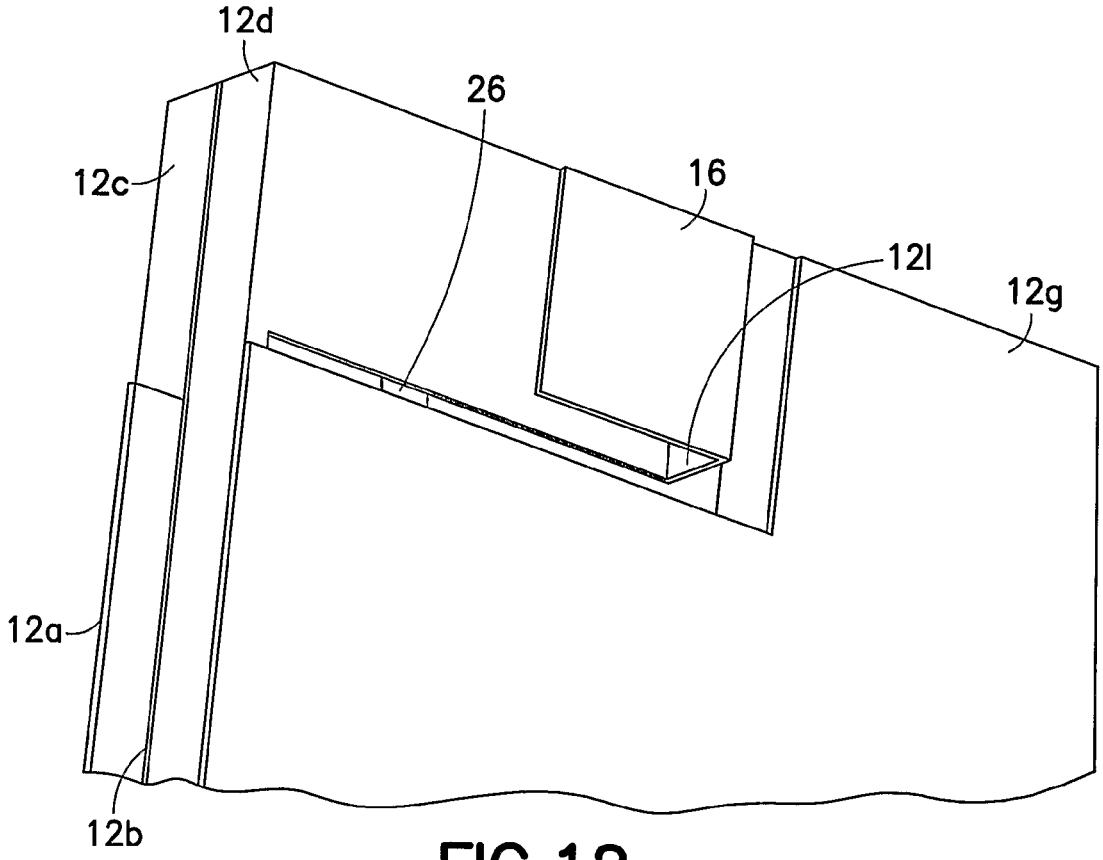
FIG. 12 is a perspective illustration of another PWB according to exemplary embodiments of the invention.

With reference to FIG. 12, there is illustrated another alternative embodiment of a multi-layer PWB according to the invention wherein a patch radiating element 16 is fabricated onto the second metalization layer 12*b* of a PWB/PCB. The patch radiating element 16 can be extended to the third metallization layer 12*g* of the PWB/PCB using a 3D-bent track (implemented with "PWB/PCB VIA" technology, for example). The benefit of this configuration is that the antenna size can further be reduced due to the patch antenna 16 existing on two layers. In the exemplary embodiment illustrated, the patch track of the patch antenna 16 comprises portions of second metallization layer 12*b* and third metallization layer 12*g* while the monopole radiating element 26 resides on the same level as the first metallization layer 12*a*. The inter-layer patch extension 121 can also be applied from one PWB/PCB to another PWB/PCB or substrate. For example, when the patch radiating element 16 is fabricated only on the top layer of a PWB/PCB, as in FIG. 11, a piece of substrate with cutout 14 size can be loaded on top of a patch radiating element 16 and the patch track can be extended/connected to the extra/second substrate. Similarly a bent piece of metal (not shown) can be attached, such as by being soldered, to the top layer surface of a PWB/PCB to act as an extension plus the additional section of the patch radiating element 16, thereby making the overall area smaller (at the cost of incurring some additional height).

The sectional view of FIG. 3 is seen as one exemplary embodiment well suited for efficient manufacturing, wherein the patch radiating element 16 and the monopole radiating element 26 are formed on opposed surfaces of a dielectric layer 12*c* of the PWB 12 itself but all metallization layers 12*a*, 12*b* (and in fact all other layers) of that PWB are cut back so as not to occupy the cutout 14 or extension 14*a* as noted. In practice, it is deemed efficient to form these layers separately with the cutouts and extensions already formed, then bond the layers together to provide a PWB as described onto which the radiating elements 16, 26 are then disposed on the first dielectric layer 12*c*. No grounding metallization is present along the slot 24. Preferably, no grounding metallization is present between the patch radiating element 16 and the monopole radiating element 26 in the areas wherein they overlie one another, and most preferably no grounding metallization exists in the areas of either the cutout 14 or the cutout 14 with its extension 14*a*. In one embodiment, the PWB 12 is a double copper plated substrate with 1 mm thickness, where the copper plating layers on opposed sides of an intervening dielectric layer exhibits the cutout 14 and cutout extension 14*a* as indicated. The patch radiating element 16 and the monopole radiating element 26 are disposed on opposed sides of that dielectric layer, which may be single or multiple dielectric layers, so long as no metallization is present in the cutout region 14.

An alternative embodiment to the sectional view of FIG. 3 forms the patch radiating element 16 and the monopole radiating element 26 on a substrate separate from the PWB 12, and then disposes that assembly adjacent to the cutout 14 so as to define the lateral spacing between edges of the radiating elements and the PWB, similar to that detailed above. The short 22 is formed and the feed point 28 is connected to couple the antenna radiating elements 16, 26 to other circuitry disposed on the PWB.

The monopole radiating element 26 performs a dual role: it is a $\lambda/4$ monopole antenna to produce the second resonance different from then first resonance of the patch radiating element 16; and it acts as a coupling feeding line to feed the patch radiating element disposed over it. When the microstrip line monopole radiating element 26 acts as a coupling feeding line, there is a high current distribution on it at the location of the slot 24. This is because the line length from the slot 24 to the furthest end of the monopole radiating element 26 is about quarter wavelength, as noted above. The size of the patch radiating element 16 may then be reduced from quarter wavelength as in the prior art to an eighth wavelength. This is because the coupling feeding from the monopole radiating element 26 in conjunction of corner shorting at the short 22 limits the patch radiating element 16 to generate only in the ⅛ wavelength mode. In addition, the monopole radiating element 26 further extends the overall bandwidth of the antenna 10.

It can be appreciated that a sixth wavelength patch radiating element 16 is created in response to the effect of the dielectric substrate used as a carrier. An example of a dielectric substrate is PCB FR4 material.

Figure 4A:
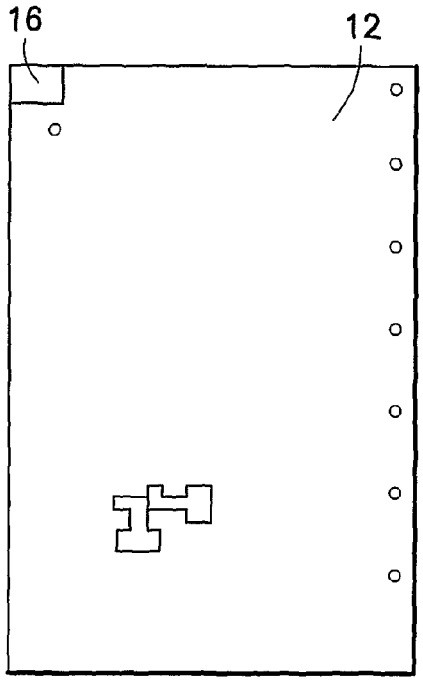
FIGS. 4A-4B are similar to the top view of FIG. 1, but with the patch radiating element respectively disposed at a corner and along a lateral side of the substrate.
Figure 4B:
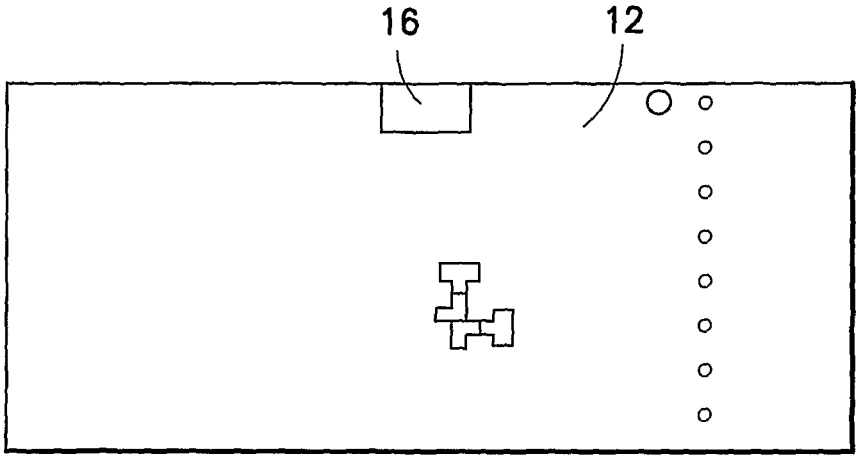
Figure 4C:
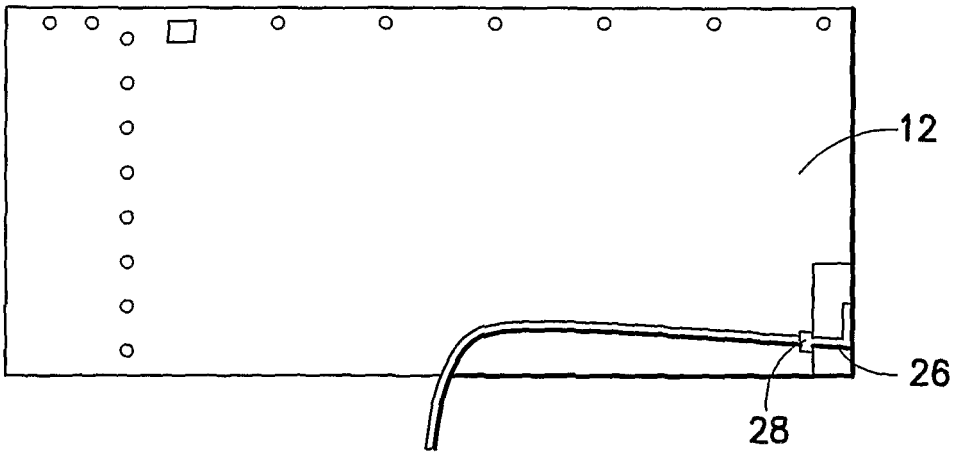
FIG. 4C is similar to FIG. 2 showing the monopole radiating element disposed at a corner of the substrate.

FIGS. 4A-4C show different configurations of the antenna 10 as tested. In FIG. 4A, the patch radiating element 16 is disposed in a corner of the PWB 12. FIG. 4C shows the reverse side of the same embodiment as FIG. 4A so that the monopole radiation element 26 is visible. Note that in FIG. 4C the monopole radiation element 26 is directly fed, rather than indirectly as noted above. This was for testing purposes. Indirect feed via an inductive connection saves space, but either feed method is fully functional.

FIG. 4B illustrates a different disposition of the patch radiating element 16 relative to the PWB 12. In this embodiment, the monopole radiating element (not shown) still underlies the patch radiating element, but the pair of radiating elements 16, 26 now are disposed along a lateral edge 30 of the PWB as opposed to a corner.

Figure 5:
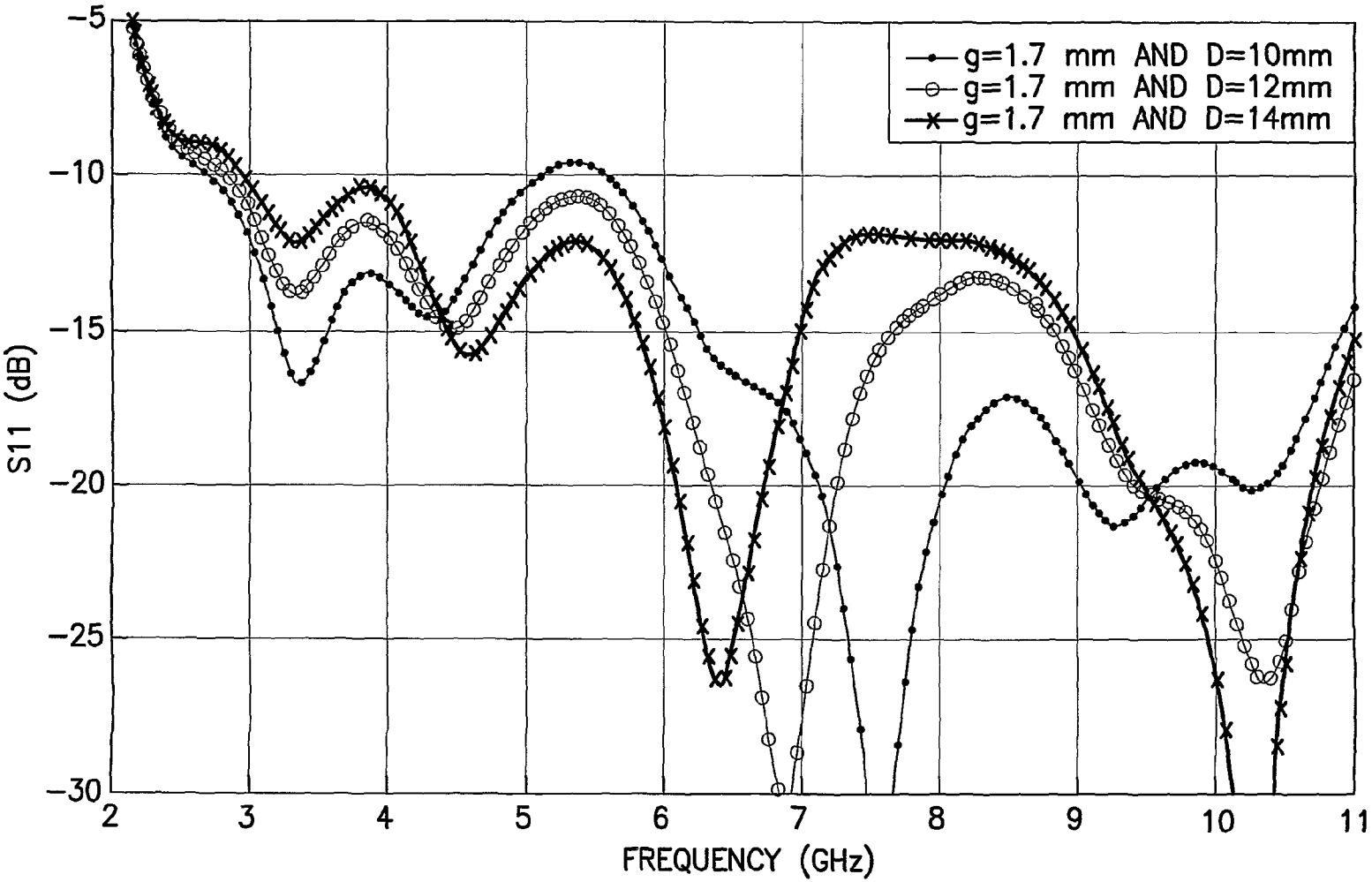
FIG. 5 is a graph of antenna return loss (dB) versus frequency for a conventional coupled monopole/patch antenna, where the patch measures 10 mm by 11 mm.
Figure 13:
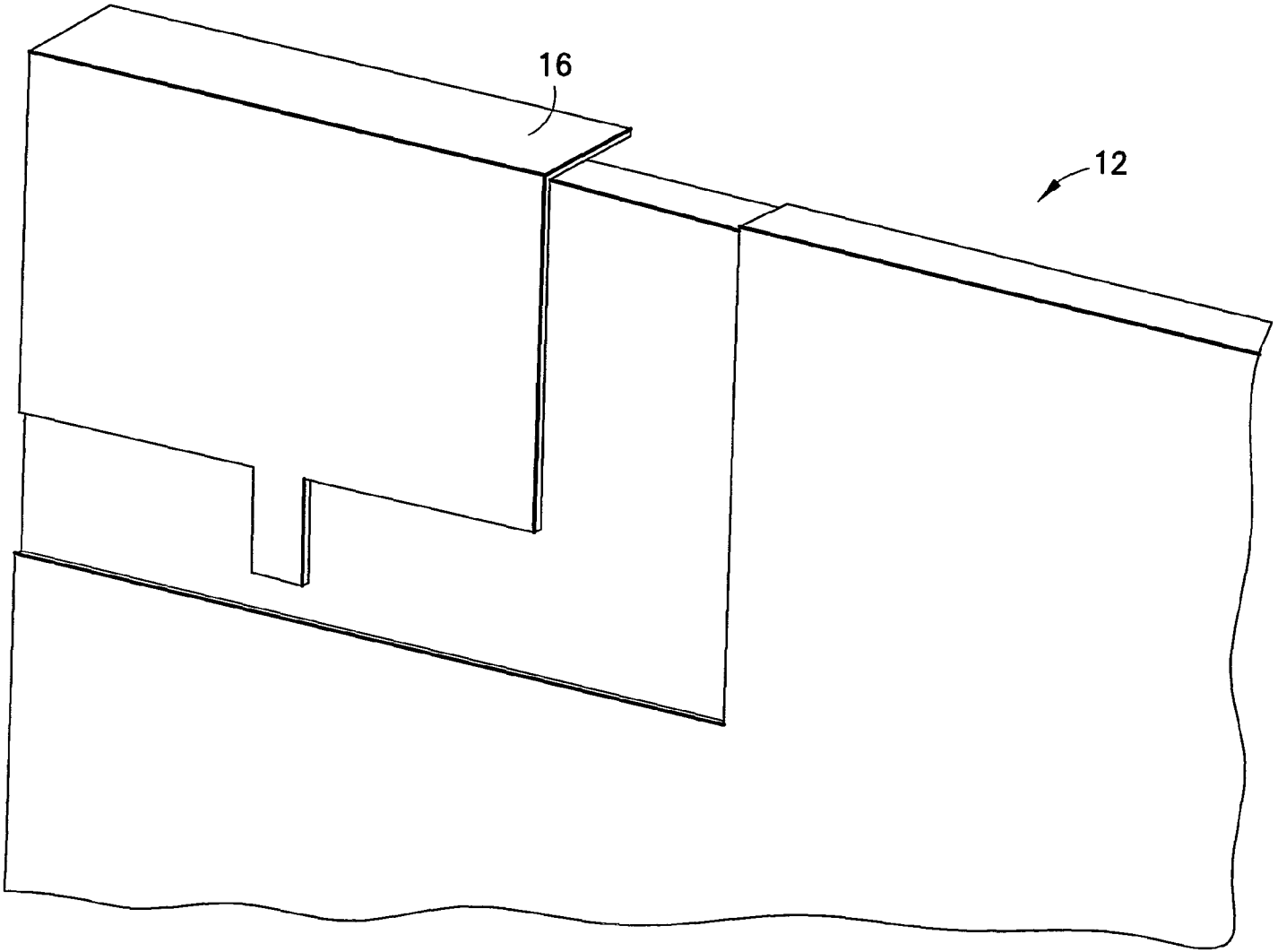
FIG. 13 is a perspective illustration of another PWB according to exemplary embodiments of the invention.

The embodiments of FIGS. 4A-4C are now compared to a conventional patch element of size 10×11 mm coupled to a monopole element, wherein the conventional arrangement lacks the slot 24 and the short 22 detailed above for embodiments of this invention. In fact, the patch radiating element 16 can be directly fed and fabricated on a single layer PWB. FIG. 5 is a graph of antenna return loss $S_{11}$ (dB) versus frequency for that conventional coupled monopole/patch antenna. The patch measuring 10 mm by 11 mm generates the lowest resonant frequency at about 3.4 GHz. With reference to FIG. 13, there is illustrated an exemplary embodiment of one such bend (or not) antenna configuration. The patch radiating element 16 can be directly fed and fabricated onto a single layer metal.

Figure 6:
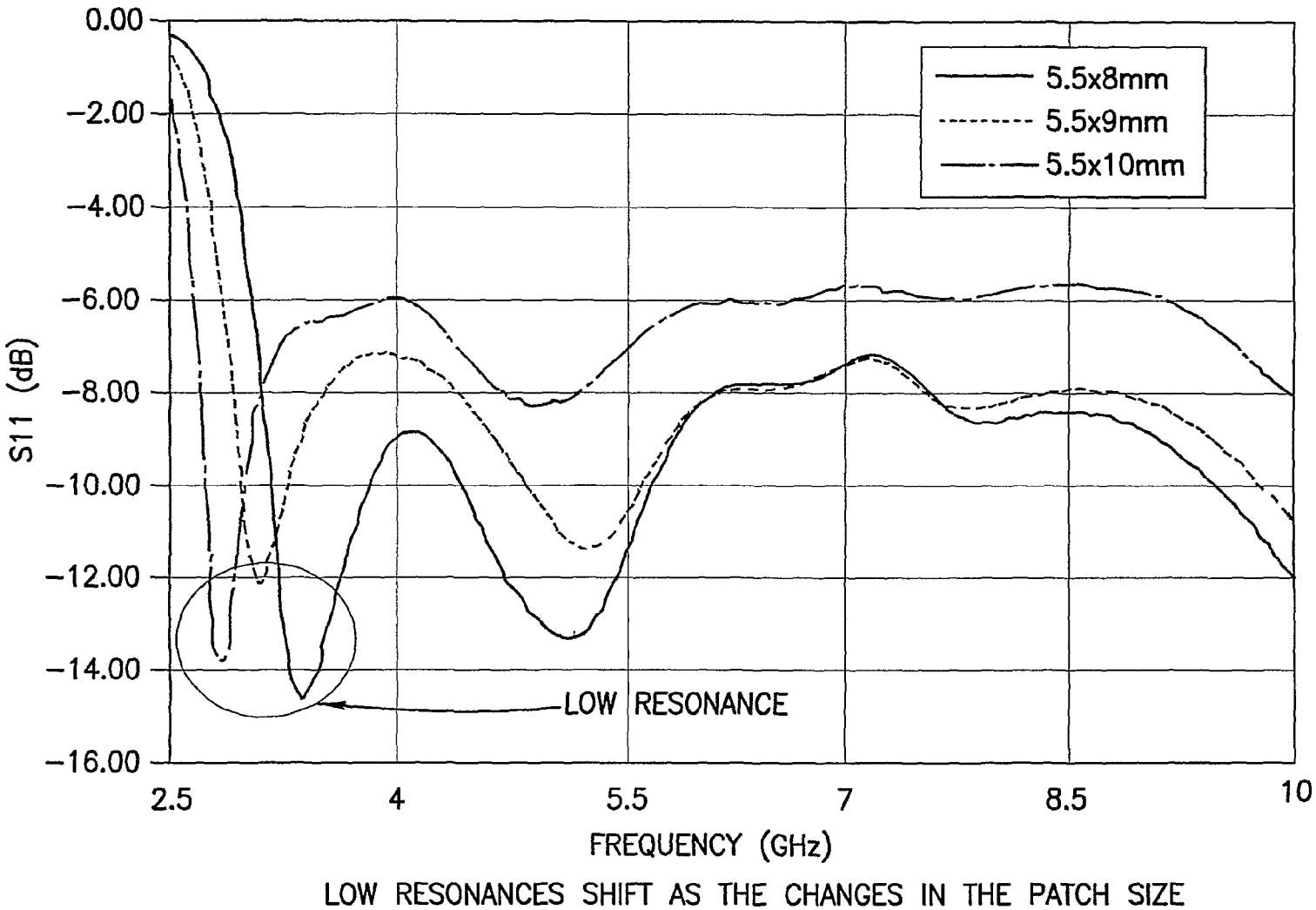
FIG. 6 is similar to FIG. 5, but for an antenna according to an embodiment of the invention and showing data for different sized patch radiating elements.

Compare the conventional (larger sized) antenna of FIG. 5 with the data of FIG. 6 for three different embodiments of this invention, where the patch radiating element measures 5.5 mm by 8 mm, 9 mm, and 10 mm, about half the physical size. In fact, the total size required by the embodiments tested in FIG. 6, including PWB clearance, is reduced even more, from 11×21 mm (prior art) to 6×11 mm, about 70% reduction in PWB area. The data of FIG. 6 show very similar resonant characteristics as that of FIG. 5, but the embodiments of FIG. 6 offer a substantial size reduction. The PWB 12 remains the same size (90×37 mm) for the data of FIG. 6, and in FIG. 8 it will be shown that the two prototypes implemented in different locations and orientation as shown in FIGS. 4A-C do not substantially degrade performance. This confirms that the antenna 10 architecture exhibits sufficient flexibility to be mounted in different PWB locations, and can be adapted readily to various architectures of various handheld portable communication devices.

FIG. 6 shows that the resonant frequency can be tuned by adjusting the patch size. When the length of the (L-shaped) monopole radiating element 26 is fixed to 12 mm and the size of the patch radiating element 16 is increased from 5.5×8 mm to 5.5×10 mm, the low resonant frequency of the antenna 10 shifts from high to low. The diagonal length of the 5.5×g mm patch radiating element 16 is 10.5 mm. The shorted monopole patch combination produces a resonance at 3.3 GHz, which confirms that the diagonal length of the patch radiating element 16 is about $\lambda/8$ of the resonant frequency. Given a fixed size of the cutout 14 at 6×11 mm. (which is sufficient for a 5.5×10 mm patch radiating element 16), lateral spacing from the PWB 12 will increase as the size of the patch radiating element is reduced. (For these patch radiating element dimensions, it is not necessary to re-configure the shape of the monopole radiating element 28) Therefore good matching is achieved for the large clearance with a small patch radiating element 16, for example, 5.5×8 mm. Its $S_{11}$ is below −7 dB within the band 3.2-10 GHz.

Figure 7:
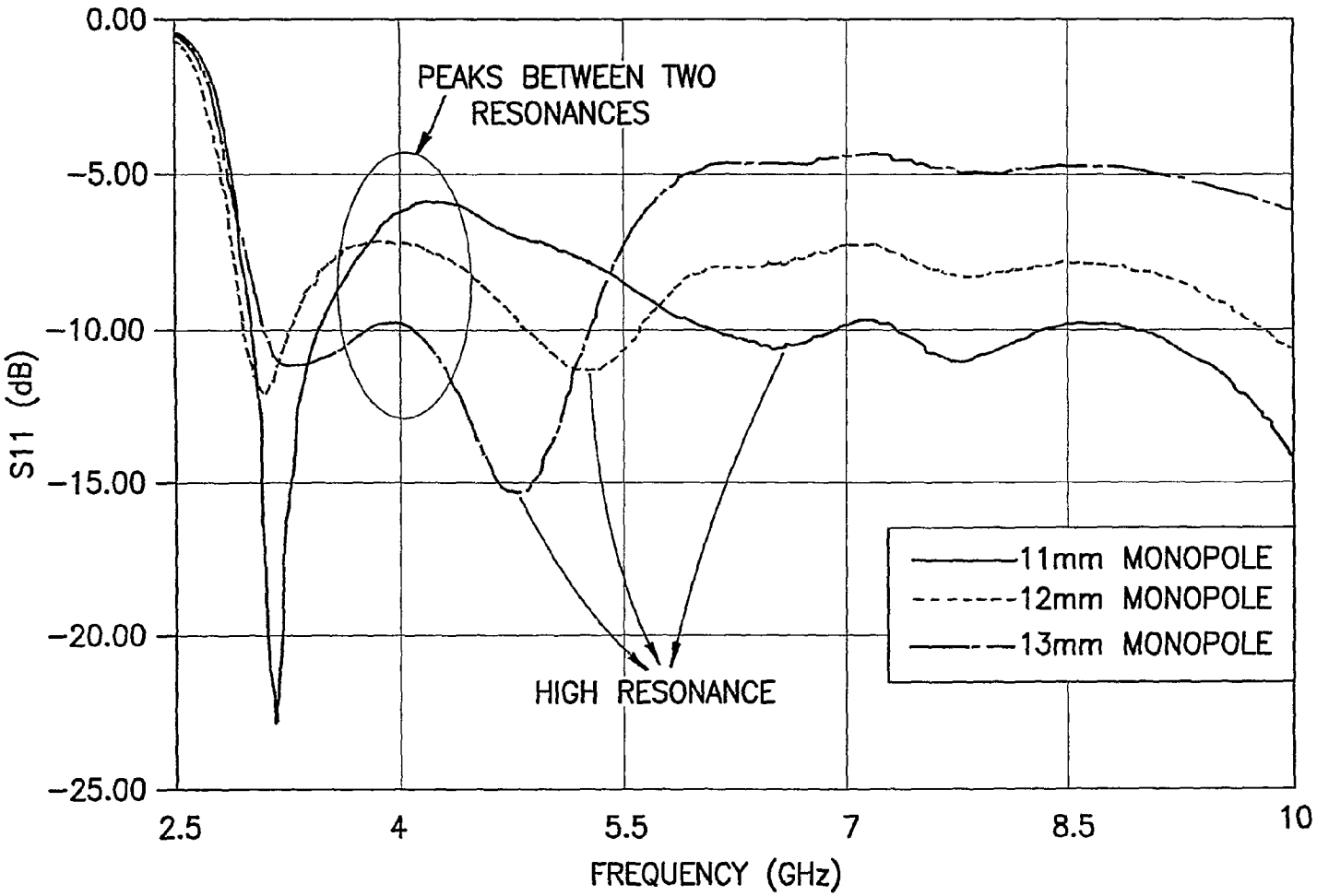
FIG. 7 is similar to FIG. 6 but showing data for different length monopole radiating elements.

The L-shaped, monopole radiating element 28 generates a high resonance around 5.5 GHz. When the size of the patch radiating element 16 is fixed to 5.5×g mm, data is shown in FIG. 7 for increasing the length of the monopole radiating element from 11 mm to 13 mm. The high resonant frequency of the monopole radiating element shifts from low to high with decreasing monopole length. Normally there is a peak between two resonances for the dual resonant elements 16, 26. If two resonant frequencies are close, the antenna 10 can achieve very good matching and consistent radiation efficiency in band, but a slightly narrowed bandwidth. To achieve a wide bandwidth, the two resonant frequencies cannot be too close to one another else the peak will rise. A compromise is required to achieve both good matching and wide bandwidth.

Figure 8:
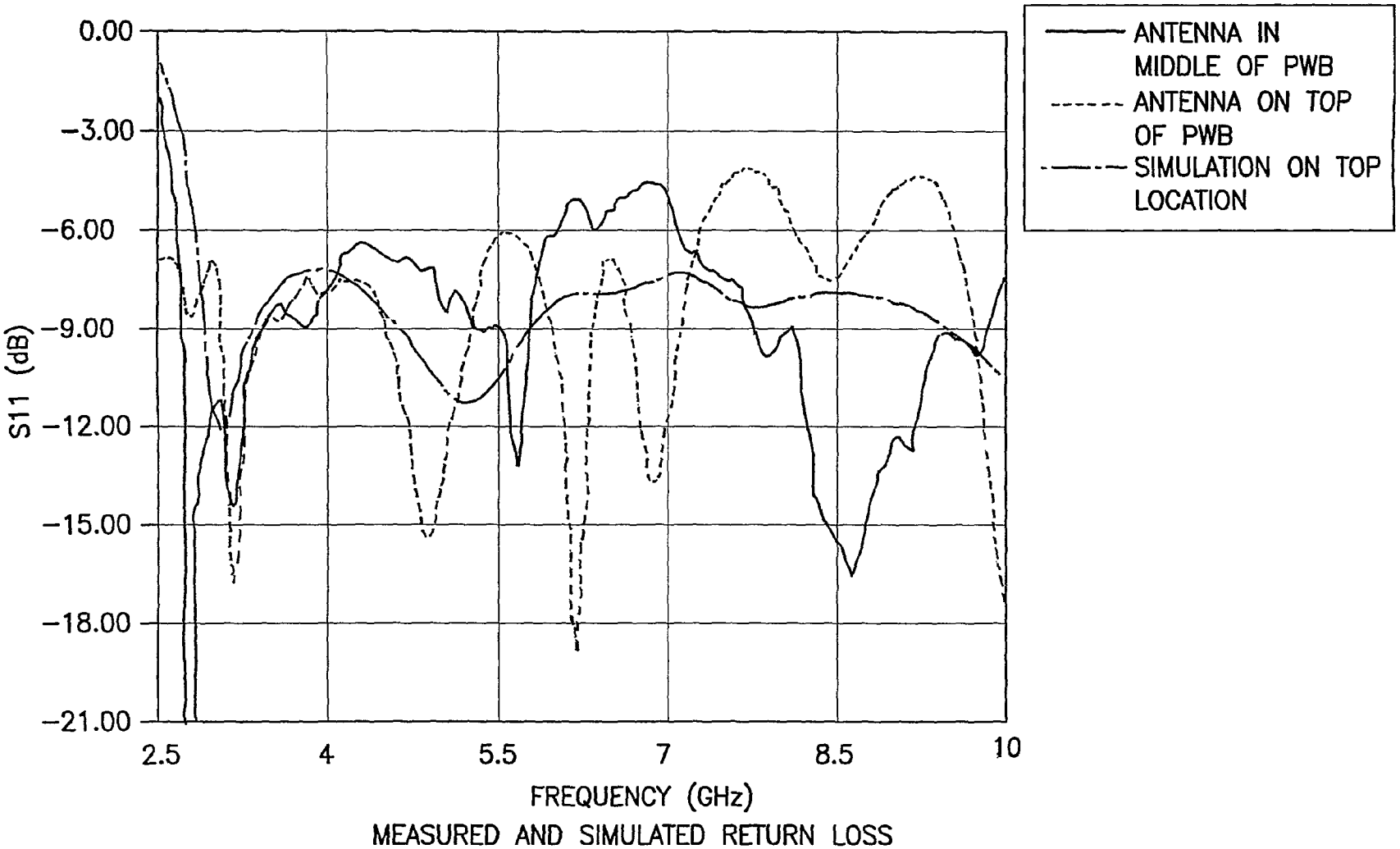
FIG. 8 is a graph of antenna return loss (dB) versus frequency for an antenna according to an embodiment of the invention, showing different responses according to different locations along the substrate.

The tested and simulated antenna return losses $S_{11}$, are in fairly good agreement at the band of 2.5-7 GHz, as shown in FIG. 8. Tested data in FIG. 8 reflects the two configurations of FIGS. 4A (on top of PWB, along a corner) and 4B (in middle of PWB, along a lateral edge).

Figure 9:
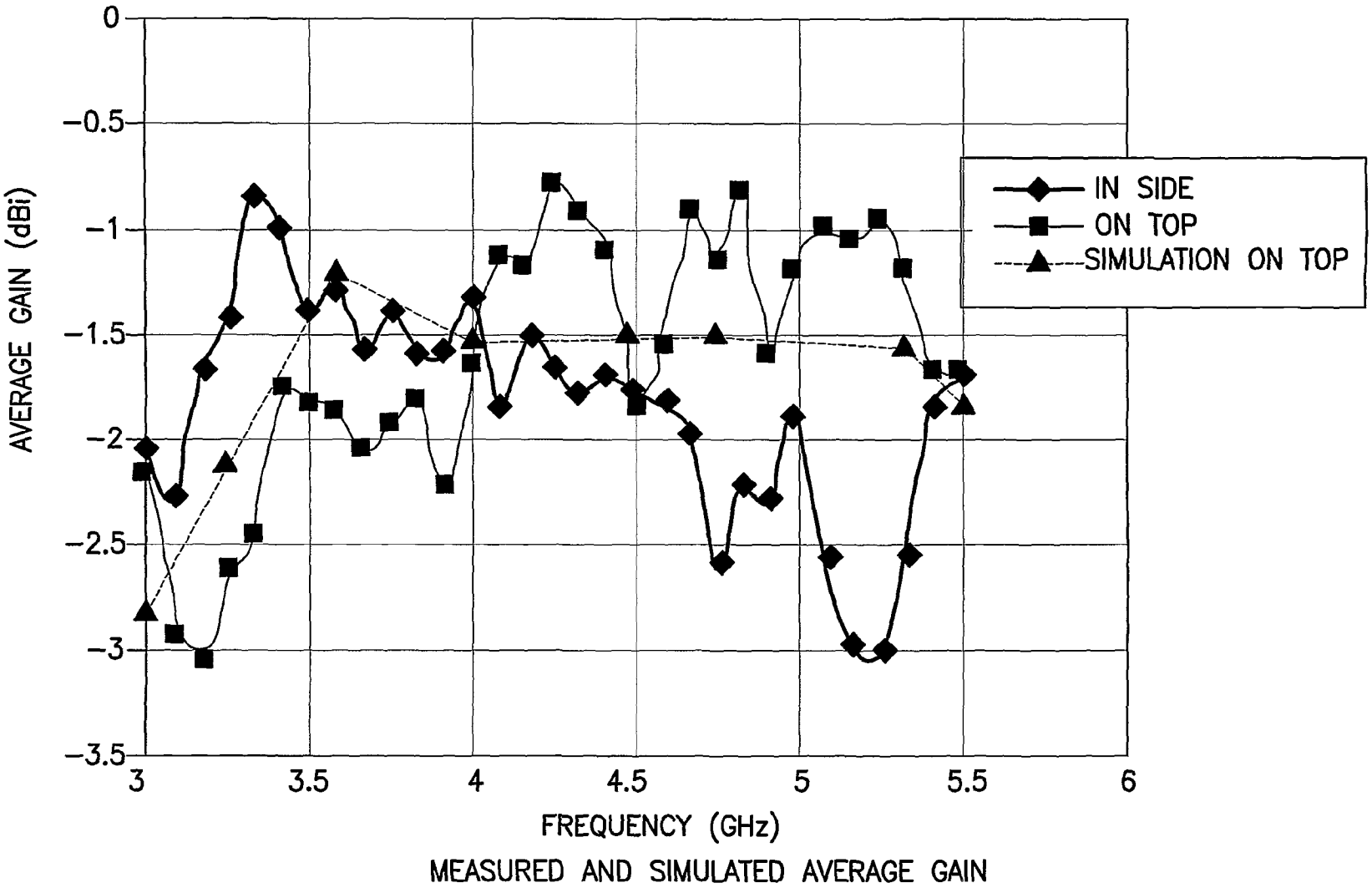
FIG. 9 is similar to FIG. 8 but showing average gain of the differently located antennas.

The UWB antenna 10 average gain (efficiency) was tested in a Satimo chamber, for which the data is reproduced at FIG. 9. The radiation efficiency can only be measured below 5.5 GHz. When the UWB antenna 10 is fabricated "on top" (along the corner of the PWB as in FIG. 4A), its gain is better than if it were disposed as in FIG. 4B along the lateral edge of the PWB (labeled "In Side" at FIG. 9). Note that even when disposed as in FIG. 4B along a lateral side rather than a corner of the PWB 12, the antenna 10 minimum gain is over −3 dBi across the entire band shown in FIG. 9. The average radiation efficiency is reasonably good. The simulated result is in good agreement with the measured result. Therefore, we may predict that the invented antenna could achieve over −3 dBi average gain in the band. Note that all of the testing and simulated data shown herein relied on the radiating elements having no metal above or below them (within a few mm at least).

It is noted that exemplary embodiments of the invention can be applied to a multitude of applications which may require wideband and or multiband resonances including, but not limited to, UWB applications, dual band designs, such as dual band WLAN (2.4 GHz and 5.2 GHz), and WiMax, as well as future systems.

Figure 10:
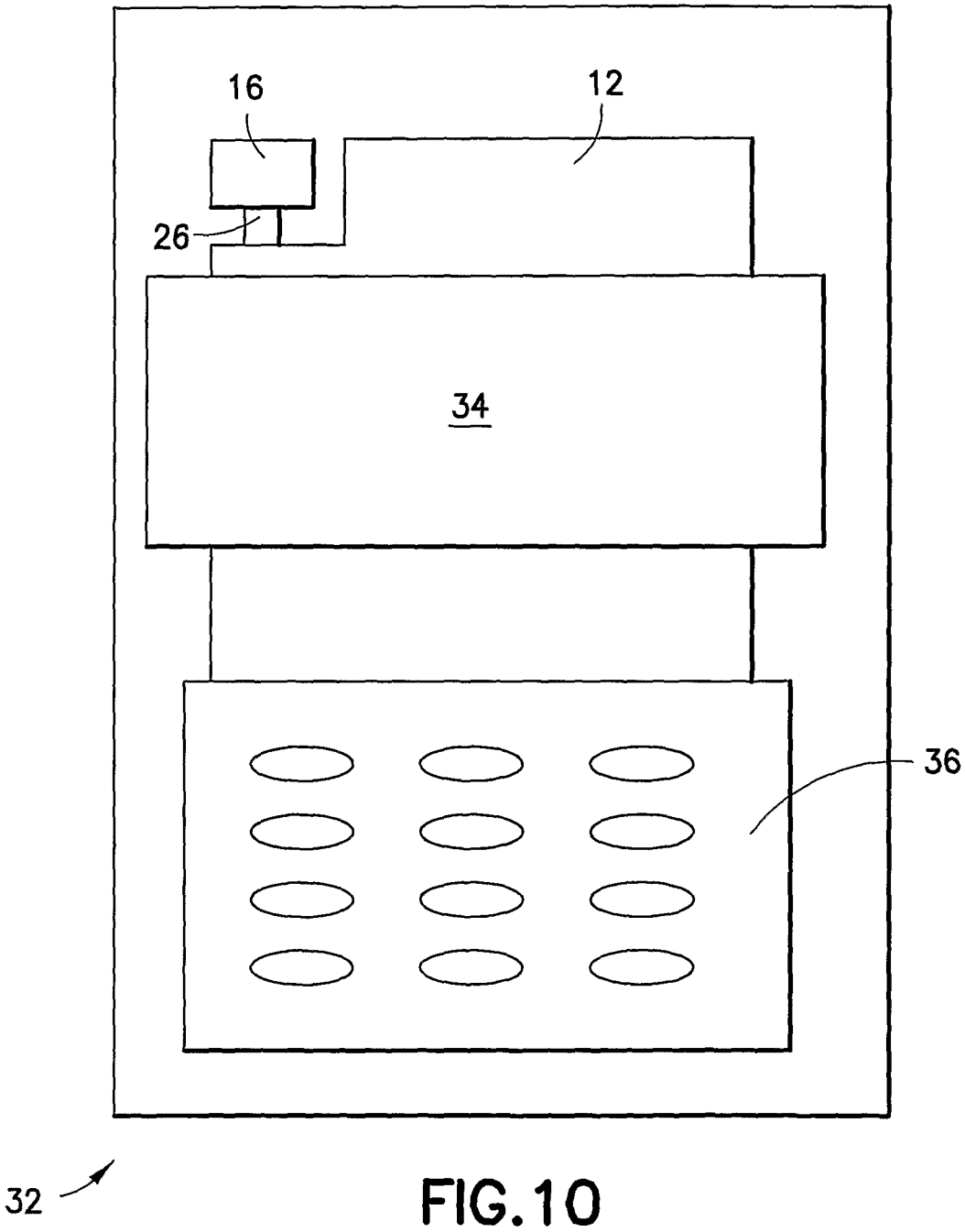
FIG. 10 is a schematic block diagram of a mobile communication device in which the antenna of FIG. 1 is incorporated.

As will be appreciated, the antenna 10 may be disposed in a portable communications device 32 such as a mobile station or other devices noted above, where the feed point 28, is coupled to a transceiver as known in the art. FIG. 10 illustrates in cutaway view such a device 32, wherein the transceiver and other circuitry are printed on or mounted to the PWB 12. A driver for a graphical display interface 34, and for a user input interface 36 such as an array of buttons, may also be mounted to the PWB 12 and be grounded to the same metallization that serves as the ground plane to the antenna 10.

Various modifications and adaptations may become apparent to those skilled in the relevant arts in view of the foregoing description, when read in conjunction with the accompanying drawings. However, any and all modifications of the teachings of this invention will still fall within the scope of the non-limiting embodiments of this invention.

Furthermore, some of the features of the various non-limiting embodiments of this invention may be used to advantage without the corresponding use of other features. As such, the foregoing description should be considered as merely illustrative of the principles, teachings and exemplary embodiments of this invention, and not in limitation thereof.

What is claimed is:

1. An apparatus comprising:

grounding metallization disposed on a substrate and having edges defining an aperture;

a monopole radiating element positioned adjacent the edges of the grounding metallization; and a patch radiating element positioned adjacent the edges of the grounding metallization and overlying at least a portion of the monopole radiating element, said patch radiating element shorted to the grounding metallization, wherein the aperture and the patch radiating element define a slot, the monopole radiating element and the patch radiating element being configured to electromagnetically couple to one another through the slot.

2. The apparatus of claim 1, further comprising a multi-layer substrate that comprises the grounding metallization, the monopole and patch radiating elements disposed on opposed surfaces of a dielectric layer of the substrate and spaced laterally from edges of other layers of the multi-layer substrate.

3. The apparatus of claim 1 wherein the monopole radiating element comprises a feeding point that does not underlie the patch radiating element.

4. The apparatus of claim 1, wherein the monopole radiating element defines a length approximately one quarter of a first resonant wavelength, and the patch radiating element defines a diagonal approximately one eighth of a second resonant wavelength.

5. The apparatus of claim 1, wherein said patch radiating element comprises a bent element formed of at least two metallization layers.

6. The apparatus of claim 1, wherein the monopole radiating element is coupled at a feedpoint that lies beyond a lateral edge of the patch radiating element.

7. The apparatus of claim 1, wherein the monopole and patch radiating elements are disposed along a corner of a substrate that comprises the grounding metallization or along a lateral edge of a substrate that comprises the grounding metallization.

8. The apparatus of claim 1 disposed in a portable communications device and coupled at a feed point of the monopole radiating element to a transceiver.

9. The apparatus of claim 1 wherein said monopole radiating element comprises a non-linear monopole.

10. The apparatus of claim 1 wherein said patch radiating element comprises a plurality of metallization layers.

11. The apparatus of claim 1, wherein the grounding metallization comprises a first layer and a second layer, and wherein the monopole radiating element spaced laterally from edges of the first layer of the grounding metallization, and the patch radiating element spaced laterally from edges of the second layer of the grounding metallization.

12. An antenna comprising the apparatus of claim 1.

13. A mobile communication device, comprising the antenna of claim 12.

14. The apparatus of claim 1, wherein the monopole radiating element is configured to feed the patch radiating element.

15. A method comprising providing grounding metallization disposed on a substrate and having edges defining an aperture;

positioning a monopole radiating element adjacent the edges of the grounding metallization; and providing a patch radiating element adjacent the edges of the grounding metallization and overlying at least a portion of the monopole radiating element, said patch radiating element shorted to the grounding metallization, wherein the aperture and the patch radiating element define a slot, the monopole radiating element and the patch radiating element being configured to electromagnetically couple to one another through the slot.

16. The method of claim 15, wherein the monopole radiating element extends beyond an edge of the patch radiating element.

17. The method of claim 15, wherein the monopole radiating element is a quarter wavelength antenna and the patch radiating element is an eighth wavelength antenna.

18. The method of claim 15, wherein providing the patch radiating element comprises disposing the patch radiating element on a first surface of a dielectric layer of the substrate that extends across the aperture, and disposing the monopole radiating element on an opposed second surface of the dielectric layer.

19. The method of claim 15, wherein the patch radiating element and the monopole radiating element are disposed on a second substrate separate from the substrate defining the at least two adjacent edges, and providing the patch radiating element comprises disposing the second substrate within the aperture.

20. The method of claim 15 wherein the aperture is located along one of:

a corner of the substrate; or along a lateral edge of the substrate, in which the at least two adjacent edges comprise a third edge adjacent to one of the two adjacent edges to form an aperture by at least three edges, and wherein providing the patch radiating element comprises disposing the patch radiating element so as to be laterally spaced from each of the at least three edges.

21. The method of claim 15, wherein the monopole radiating element is configured to feed the patch radiating element.

22. An apparatus comprising:

first antenna for radiation in a first frequency band, wherein the first antenna comprises a monopole radiating element;

second antenna, inductively coupled to the first antenna, for radiation in a second frequency band, wherein the second antenna comprises a patch radiating element; and grounding metallization spaced from lateral edges of the first and second antenna and shorted to the second antenna, the spacing between the grounding metallisation and the second antenna defining a slot, the first antenna and the second antenna being configured to inductively couple to one another through the slot, wherein the grounding metallization is plated to a substrate, wherein the monopole and patch radiating elements are disposed on opposed surfaces of a dielectric layer of the substrate and spaced laterally from edges of other layers of the substrate and wherein at least a portion of the first antenna overlies at least a portion of the second antenna.

23. An antenna comprising the apparatus of claim 22.

* * * * *